United States Patent [19]

Jensen et al.

[11] 3,981,496

[45] Sept. 21, 1976

[54] STRIPPING AND TRANSFER ROLLER ASSEMBLY FOR SHEET FILM PROCESSORS

[75] Inventors: Gerald A. Jensen, Wayzata; Conrad E. Lee, Mound, both of Minn.

[73] Assignee: Pako Corporation, Minneapolis, Minn.

[22] Filed: Oct. 14, 1975

[21] Appl. No.: 622,093

[52] U.S. Cl. ..... 271/80; 226/5; 226/186; 226/191; 271/DIG. 2; 271/174

[51] Int. Cl.[2] ..... B65H 29/22

[58] Field of Search ..... 226/5, 186, 191; 271/80, DIG. 2, 174, 177

[56] References Cited

UNITED STATES PATENTS

| | | | |
|---|---|---|---|
| 3,042,281 | 7/1962 | Balvin | 226/191 X |
| 3,363,816 | 1/1968 | Maddock | 226/186 |
| 3,727,912 | 4/1973 | Vos | 271/51 |

*Primary Examiner*—Richard A. Schacher
*Attorney, Agent, or Firm*—John W. Adams

[57] ABSTRACT

A stripping and sheet transfer roller assembly particularly constructed for use in sheet film processors and which includes a pair of cylindrical rollers positioned in closely spaced relation for driving individual sheets of film through a dryer and thereafter transfer the same laterally while in substantially upright position into a receiving bin disposed in close association to said rollers, one roller having a plurality of spaced apart soft compressible stripping and transfer elements attached in radially extending relation to the periphery of the rollers and are radially compressed when said sheet passes between said pair of rollers and which expand as said elements rotate out of contact with said sheet, the expansion of said elements stripping the sheet from the stripping roller, said expanded elements then engaging the trailing edge of each stripped sheet to transport said edge laterally and deliver the sheets into said bin in substantially upstanding position in said bin.

2 Claims, 4 Drawing Figures

STRIPPING AND TRANSFER ROLLER ASSEMBLY FOR SHEET FILM PROCESSORS

In the past, two general difficulties have been associated with roller assemblies used in film sheet processors. The first was maintaining good driving contact between the sheet and the rollers without damaging the surface of the film. The second difficulty was in preventing the film from sticking to the rollers and thus damaging the sheets.

In U.S. Pat. No. 3,363,816 granted to R. B. Maddock and entitled ROLLER CONSTRUCTION FOR STRIPPING SHEET MATERIAL FROM TRANSPORT ROLLERS, rollers are provided with stripping elements in the form of rings or spiral strips of soft compressible material which, when expanded, extend beyond the outer surface of said rollers and which compress upon contact with the film sheet being transported thereby. This ensures good driving contact between the rollers and the sheet. As the rollers are rotated out of contact said stripping elements expand to their original thickness and force, or strip, said film away from the surface of said rollers.

A third problem is associated with the delivery of the upstanding film sheets into a film-receiving bin. The bins are usually mounted to receive the sheets in a substantially upright position. The problem lies in transporting the film in an upright position from the last pair of rollers into said bin.

In U.S. Pat. No. 3,532,048 issued to Henry and Stephen F. Hope and entitled X-RAY FILM PROCESSING MACHINE, the roller closest to film-receiving bin is provided with a plurality of axially spaced grooved rings. The side of the bin nearest said rollers is substantially open so that the leading edge of the sheet being transported between said rollers rides up along the remote side of the bin. The trailing edge of the sheet falls into said groove and is transported laterally by the rotation of the grooved roller until the trailing edge drops out of said groove and into the bottom of the bin, and the sheet will assume a substantially vertical position in said bin. However, these grooved rings may cause damage to the film sheets.

The present invention comprises a plurality of soft compressible stripping and transfer elements circumferentially spaced around the stripping roller positioned in closest proximity to the sheet-receiving bin. A sheet of film passes between said stripping roller and a pressure roller adjacent thereto and the leading edge of the sheet slides up the remote side panel of the bin. The elements are radially compressed when rotated into contact with the sheet to provide good driving contact between the rollers and the sheet of film. When said compressed elements are rotated out of registration with said other roller, they expand radially to their original thickness and thus force, or strip, the film away from the one roller. Said expanded elements extend outwardly beyond the roller periphery to provide an abutment for engaging the trailing edge of said stripped film sheet and are rotated to transfer said trailing edge laterally towards said bin until the trailing edge falls away from the elements and into the sloping bottom of said bin, thereby depositing said stripped sheet in a substantially upright position in the bin.

The details and advantages of this invention will more fully appear from the following description.

Figure 1:
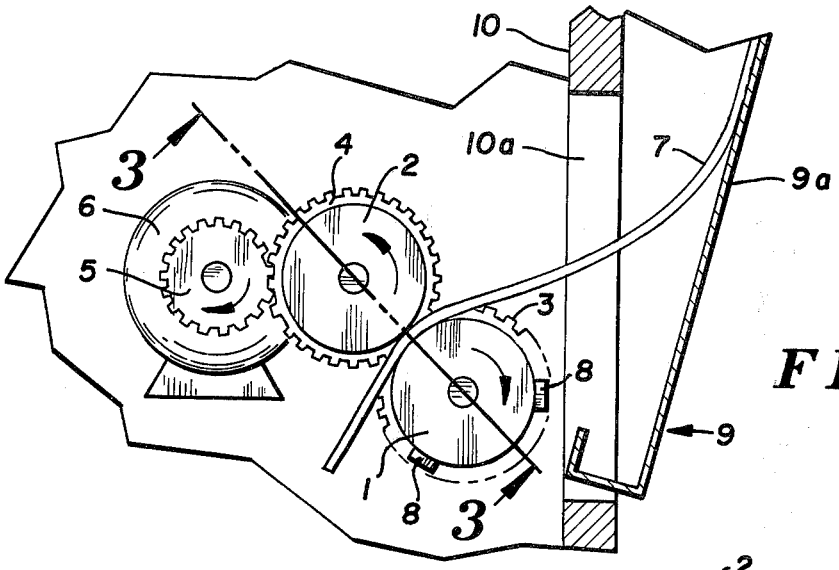
FIG. 1 is a front elevational view of the roller assembly and film sheet-receiving bin.
Figure 2:
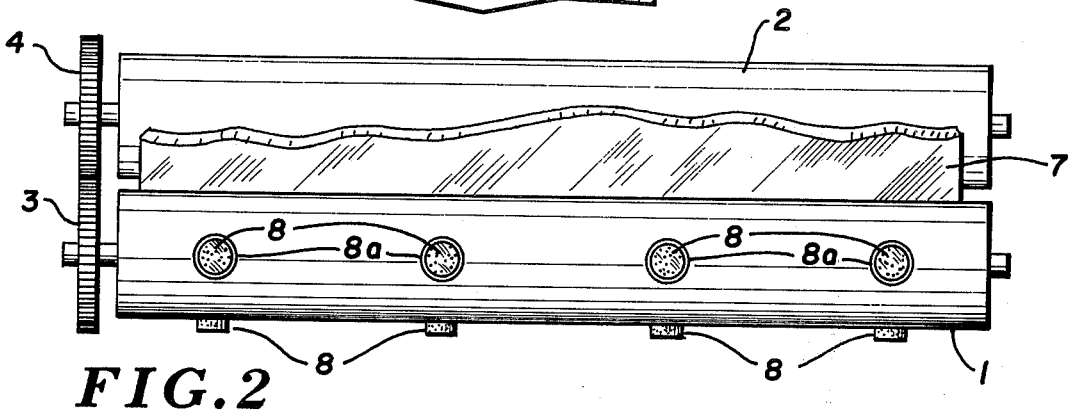
FIG. 2 is a side elevational view of the roller assembly.
Figure 3:
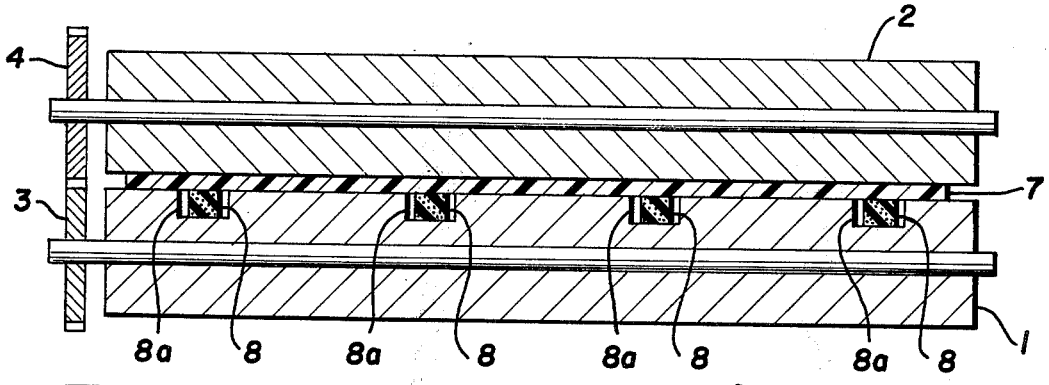
FIG. 3 is a cross-sectional view of the roller assembly taken substantially along the line 3—3.

Referring to FIG. 1, a pair of rollers 1 and 2 are positioned in closely spaced parallel relation to each other and are interconnected by the pair of meshing gears 3 and 4. Said gear 4 is also meshed with drive gear 5 of motor 6. Said pair of rollers 1 and 2 are also closely disposed towards a discharge opening 10*a* of processor wall 10. A plurality of soft compressible stripping and transfer elements 8 are circumferentially spaced about stripping and transfer roller 1 in recesses 8*a*, as best shown in FIG. 3. A generally upstanding film sheet-receiving bin 9 is positioned in closely spaced relation to roller 1 and extends through opening 10*a* of wall 10 and has the side nearest roller 1 open to permit the sheets of film 7 to pass into the bin. A sheet of film 7 is shown positioned between rollers 1 and 2 and in driving contact therewith.

In typical operation, means (not shown) transport sheet 7 into contact with rollers 1 and 2. Motor 6 rotates rollers 1 and 2 and thus drives sheet 7 between rollers 1 and 2 and into contact with the closed, remote panel 9*a* of bin 9.

As elements 8 are rotated into contact with roller 2, they are radially compressed until their length equals the depth of recesses 8*a*, as shown in FIG. 3. The compressed elements 8 press upwardly on sheet 7 and provide good frictional driving engagement of sheet 7 by rollers 1 and 2 and elements 8.

As roller 1 is rotated, the elements 8 are moved out of contact with roller 2 and expand to their normal thickness. This expansion forces, or strips, sheet 7 from roller 1.

Figure 4:
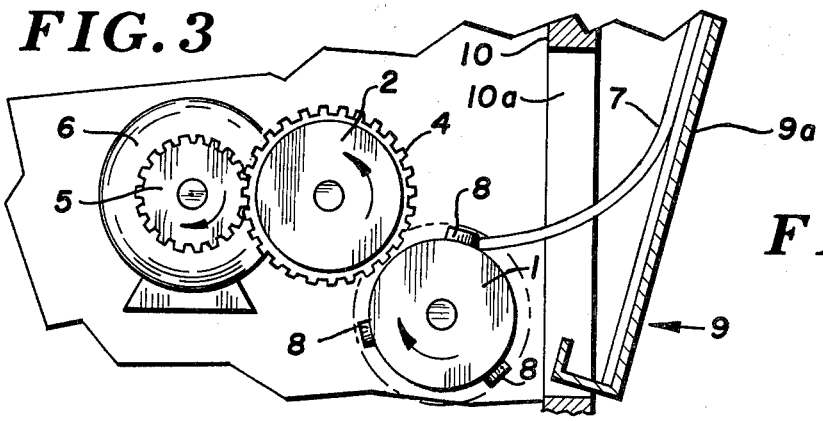
FIG. 4 is a front elevational view of the roller assembly showing the engagement of the trailing edge of a film sheet by the elements.

Rollers 1 and 2 drive the loading edge of sheet 7 into contact with wall 9*a* which forces sheet 7 to move upwardly as shown in FIG. 1. When the trailing edge of sheet 7 is driven out of contact with roller 2, it momentarily slips along roller 1 until it engages elements 8. As roller 1 rotates, the elements 8 in contact with the lower edge move it laterally and towards bin 9, as best shown in FIG. 4. The trailing edge will eventually fall from roller 1 and onto the sloping bottom of bin 9. In this manner sheet 7 is deposited in a generally upright position in bin 9, as shown.

It will, of course, be understood that various changes may be made in the form, details, arrangement and proportion of the parts without departing from the scope of the invention, which generally stated, consists in the matter set forth in the accompanying claims.

What is claimed is:

1. A stripping and transfer roller assembly for discharging individual sheets of film from a processing machine and comprising, a first roller forming a stripping and transfer roller, a plurality of soft compressible stripping and transfer elements mounted on said roller in circumferentially spaced relation therearound, a second roller positioned in close parallel relation to said first roller compressing said elements when a sheet of film is being driven between said rollers to provide positive frictional driving contact between said sheet and said rollers, a film receiving bin in close side by side relation to the stripping and transfer roller, said rollers driving said sheet into said bin to maintain said sheet into a substantially upright position, said elements expanding beyond the periphery of said first roller as they are rotated out of contact with said second roller to strip said sheet from said first roller, and said expanded elements then being rotated into engagement with the trailing edge of said stripped sheet to transfer said trailing edge laterally towards said bin and depositing said sheet in upstanding position into said bin.

2. The assembly set forth in claim 1 and said stripping and engaging elements mounted in recesses formed in said first roller, said elements normally extending beyond said recesses but being compressed into said recesses by said second roller and a sheet passing between said rollers to provide driving contact between said sheets and said first roller.

* * * * *